US005122940A

United States Patent [19]

Wiegand

[11] Patent Number: 5,122,940

[45] Date of Patent: Jun. 16, 1992

[54] BANKLIGHT AND METHOD OF UNIFORM DIFFUSE LIGHTING

[76] Inventor: Gregory P. Wiegand, 1758 Jacobson Rd. NE., Poulsbo, Wash. 98370

[21] Appl. No.: 470,853

[22] Filed: Jan. 26, 1990

[51] Int. Cl.[5] ..... F21V 21/00

[52] U.S. Cl. ..... 362/249; 362/11; 362/17; 362/243; 362/245; 362/246; 362/300; 362/320; 40/563

[58] Field of Search ..... 362/812, 3, 11, 16, 362/17, 31, 249, 320, 343, 208, 300, 243, 245, 246, 225, 99; 40/546, 563; 52/28

[56] References Cited

U.S. PATENT DOCUMENTS

| | | | |
|---|---|---|---|
| D. 204,796 | 5/1966 | Harrison et al. | D48/20 |
| 384,151 | 6/1888 | Gould | 362/16 |
| 3,605,309 | 9/1971 | Beaty et al. | 40/563 |
| 3,653,138 | 4/1972 | Cooper | 40/563 |
| 4,335,421 | 6/1982 | Modia et al. | 362/223 |
| 4,484,421 | 11/1984 | Williams et al. | 52/28 |
| 4,613,930 | 9/1986 | Ambasz | 362/223 |
| 4,616,296 | 10/1986 | Westgaard et al. | 362/33 |
| 4,669,031 | 5/1987 | Regester | 362/16 |
| 4,674,211 | 6/1987 | Pratt | 40/563 |
| 4,729,067 | 3/1988 | Ohe | 362/26 |
| 4,791,540 | 12/1988 | Dreyer et al. | 362/97 |

*Primary Examiner*—Ira S. Lazarus
*Assistant Examiner*—Sue Hagarman
*Attorney, Agent, or Firm*—Patrick Michael Dwyer

[57] ABSTRACT

The present invention discloses a unique banklight apparatus and a method for uniform diffuse illumination of large photographic subjects. The banklight includes a reflecting panel, multiple lines of light source rows and diffusing panels for providing uniform illumination of subjects.

13 Claims, 8 Drawing Sheets

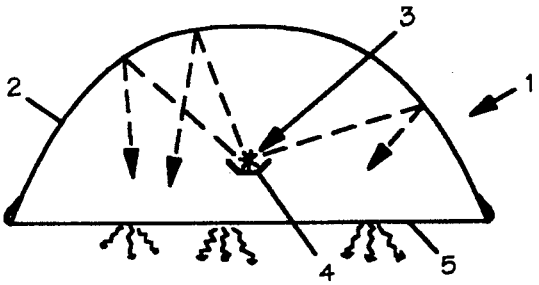
FIG.11 [prior art]
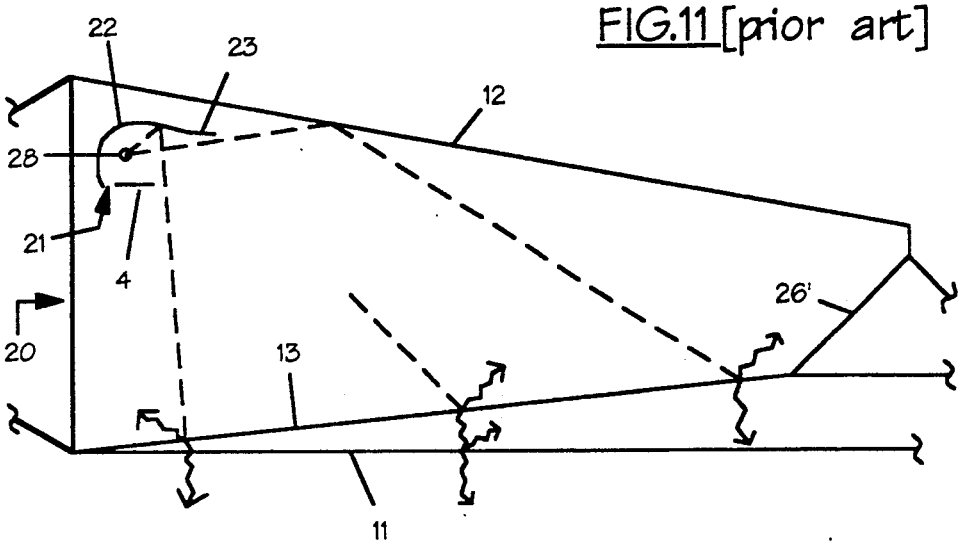
FIG.9
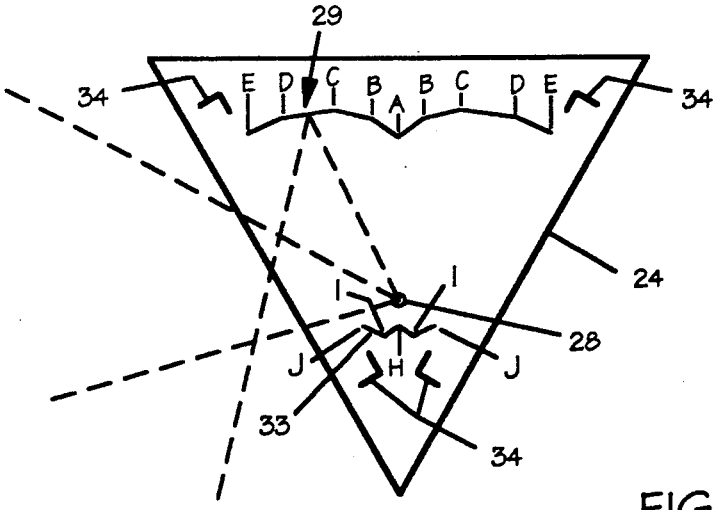
FIG.8

BANKLIGHT AND METHOD OF UNIFORM DIFFUSE LIGHTING

TECHNICAL FIELD

This invention relates to an apparatus and method for uniform diffuse illumination of objects. More particularly, the invention relates to a banklight apparatus and a method for uniform diffuse illumination of large photographic subjects.

BACKGROUND OF THE INVENTION

The need for an apparatus capable of diffusely illuminating a variety of objects and subjects is well known. See for instance U.S. Pat. Nos. 4,335,421 and 4,669,031, respectively disclosing apparati for illuminating x-ray negatives from behind or photographic subjects directly, and discussing other uses such as illuminated tracing tables. All of these applications require either a diffusely illuminated surface (for lighting from behind) or a surface which radiates a diffuse light for direct illumination. A number of apparati have been proposed to suit these applications. See for instance the U.S. patent numbers reference above. In the photographic industry, particularly in that branch of the industry dealing with the photography of large subjects for advertising or editorial purposes such as for display quality photographs of new automobiles, an apparatus generally referred to as a banklight or softlight is employed. These banklights are generally large compared to other lighting fixtures, as they are generally in the size range of ten feet wide by thirty feet long, although both larger and smaller versions are also known. Conventional banklights are known to produce an approximation of diffuse light, but they are large, cumbersome, and time consuming in set-up and takedown, and therefore very expensive to operate. One such conventional banklight apparatus in shown generally in cross-section in FIG. 11. The reflective surface of such a banklight may be a parabolic, ellipsoidal, or circular curve, and the light source schematically shown is typically a line of photo flashtubes or quartz halogen lamps. The diffusing fabric attempts to make up for the nonuniformity of the reflected light rays coming from the reflecting surface, but is only partially successful in doing so.

None of the known apparati are capable of quick and easy set-up and take down and none of them are well adapted for banklight configurations as large as eighteen by forty-eight feet, or even larger. In addition none of the known systems employ multiple lines of light sources, each line independently controlled so as to produce, when desired, a gradual and uniform variation of light intensity across the surface of the light fixture, and no known apparatus employs a system of reflecting and diffusing panels to achieve, as desired, either a virtually uniform diffusion of light, or a controlled gradation of diffuse light, while at the same time achieving a very low ratio of thickness of the apparatus to its width.

DISCLOSURE OF THE INVENTION

Accordingly it is an object of the invention to provide an apparatus and method which can be used for a wide range of applications requiring either a diffusely illuminated surface, or a lighting fixture capable of projecting either uniformly diffuse light or controlled gradations of diffuse light.

It is a further object to provide such an apparatus which has a low ratio of thickness to width, while at the same time maintaining a virtually uniform diffusion of light at its primary diffusing surface.

It is a more particular object of the invention to provide a banklight apparatus which can produce a virtually uniform diffusion of light at its flat diffusing surface for illuminating objects, such as for photography, but which is alternatively capable of being controlled so that the intensity of light across the diffusing surface of the apparatus of the invention may be selectably varied from side to side, from end to end, or be localized in subareas.

It is a further object of the invention to provide a banklight apparatus as described above which is capable of relatively quick and easy set-up and take-down which can be collapsed and stored and transported in a size much smaller than it occupies when in use.

More particularly, it is an object of the invention to provide a banklight apparatus employing reflecting and diffusing panels stretched across a frame comprised of triangular trusses.

These and other objects of the invention which will become apparent are accomplished by the means and in the manner herein set forth. The apparatus of the invention comprises two or more light source rows and an assembly of reflecting and diffusing panels stretched across an open frame. A reflecting panel is disposed across the rear of the frame, a primary diffusing panel is disposed across the front of the frame, and one or more secondary diffusers are disposed across the frame and between the reflecting panel and the primary diffusing panel. Preferably, the frame is more or less rectangular in dimension and comprised of triangularly cross sectioned truss sections, and the panels are therefore also preferably rectangular in shape to conform to the general shape of the frame. Each light source row preferably has its own associated reflector. The light source rows are preferably positioned at or near the long edges of the reflecting panel, and preferred reflectors serve principally to direct light across the reflecting panels from both edges so as to provide at the primary diffusing panel a uniform distribution of light intensities. The shape, positioning, and aiming of reflectors is empirically derived for each type and size of banklight with a mind toward maximizing this uniform distribution.

The method of the invention comprises the following steps: first, light is directed from a plurality of light source rows toward a reflecting panel which is so disposed in relation to a secondary diffuser that the directed light is reflected by the reflecting panel onto the secondary diffuser; light which passes through the secondary diffuser then strikes a primary diffusing panel disposed to receive and further diffuse the light from the secondary diffuser.

In general a panel of light reflecting material is disposed across the rear of the frame and serves as the primary reflecting surface for the apparatus with respect to light coming from either of two light source rows disposed along the long sides of the reflecting panel. A panel of diffusing material is disposed across the front of the frame and serves as the primary diffuser for the apparatus. Disposed between the primary diffusing panel and the reflecting panel is a secondary diffuser. In preferred embodiments, this secondary diffuser is not parallel to the other panels but is disposed at angles to the other panels by means of one or more yokes described below.

In simpler embodiments of the apparatus of the invention, there will be one each of the above three described panels, disposed and arranged as described above. In other embodiments, however, there may be more than one of the reflecting panels and sometimes more than one of the secondary diffusers. A need for multiple reflecting panels and/or secondary diffusers will typically arise where banklights wider than ten feet are built, and for both structural engineering reasons which will be apparent to those skilled in the art, and to maintain the low ratio of thickness of the apparatus to its width, an additional central longitudinal truss member is added to the apparatus, thereby creating a pair of rear frame openings while at the same time preserving a single front frame opening.

In these embodiments, the front frame opening will be covered as in other embodiments by a single primary diffusing panel, but each of the rear frame openings will have its own reflecting panel. Since ideally each reflecting panel should have disposed along both of its longer outer edges a light source row, in these larger embodiments a third light source row runs within the added central longitudinal truss member. Thus each of the two reflecting panels on these larger embodiments has two light source rows, one along each of its long sides. Of course, the light source row within the additional truss member serves a common function as a light source row for both reflecting panels.

Each apparatus employs one or more yokes of material for the correct shaping and spacing of the secondary diffuser and of the reflecting panel with respect to one another. These yokes interengage both the reflecting panel and the secondary diffuser in such a way as to create empirically the proper geometry for reflection and diffusion for a particular light source and reflector placement within the apparatus. Generally a single yoke is sufficient for apparati of up to ten feet in width of primary diffusing panel, whereas generally wider apparati will benefit from two or more reflecting panels and two or more such yokes.

Where two or more yokes are employed, either as a matter of design choice, or in order to facilitate a wider apparatus as discussed above, as for instance for an eighteen foot wide apparatus in one embodiment, there is a central longitudinal region of the frame in which a longitudinal truss member is disposed for greater torsional rigidity and stability of the apparatus, and in which to mount a third light source row running along the length of the apparatus. This third light source row has its own, and somewhat differently shaped reflector, in that it is comprised of both a bottom reflector to prevent direct spillage of light to the diffusing medium below and a longitudinally symmetrical gull wing shaped reflector for initially directing the light from the light source to either side of the central truss member.

In one embodiment, light emitted from the two light source rows, each disposed along either long side of the frame, is initially reflected and directed rearwardly and centrally toward the reflecting panel by the reflector associated with each respective light source row. Light reflected forwardly from the reflecting panel then strikes the secondary diffuser. Because of typical light handling properties of diffusive materials, approximately half of the light incident to the secondary diffuser is reflected back toward the reflecting panel and is thus reflectively recycled for additional diffusive effect. The light which passes through the secondary diffuser illuminates the primary diffusing panel and is thereby further diffused. In preferred embodiments the above mentioned yokes, which will be formed as more particularly described further herein, are dihedral in structure. The vertex of the dihedral is attached to the longitudinal centerline of the reflecting panel and the out two edges of the dihedral are attached symmetrically to the secondary diffuser. In preferred embodiments the yoke is a dihedral of two composite fabric panels, each composite fabric panel composed of alternating sections of diffusing material and mesh material so disposed along both composite panels that a mesh section on one panel of the dihedral is generally opposed by a diffusing fabric section on the other panel of the dihedral. Thus convection cooling air is free to pass and circulate from side to side of the apparatus through the mesh sections, but light is not free to pass undiffused from one side of the yoke to the other.

It will be appreciated, especially where convection cooling is not regarded as an important factor, that the dihedral panels of the yoke need not contain any mesh. This preferred configuration for the yoke is generally used in combination with light source rows placed relatively rearwards and at the edges of the reflecting panels, each with a reflector shaped and positioned to direct light emitted by the light source row rearwardly and towards the center of the reflecting panel and toward the yoke, and also positioned to avoid casting a shadow on the primary diffusing panel.

This preferred configuration of the yoke provides optimum blending of light intensities measured along the width of the primary diffusing panel on either side of the yoke, and provides the best performance during both uniform diffusion illumination with the apparatus and illuminations with the apparatus requiring a gradation in light intensity across the surface of the primary diffusing panel.

Alternate yoke configurations which have been considered and tested, but which yield less than optimum performance are as follows: 1) a simple sewn seam along the longitudinal centerline of the reflecting panel so as to join the reflecting panel to the secondary diffuser along that seam; and 2) a yoke substantially as described above for preferred embodiments except that the vertex of the yoke is attached to the longitudinal centerline of the secondary diffuser instead of to the reflecting panel, and the outer two edges of the yoke are attached to the reflecting panel. Method (1) exhibits relatively poor blending during gradation of the light, and the area immediately forward of the intersection of the reflecting panel and the secondary diffuser lacks sufficient illumination to achieve an overall evenness of +/−15% during uniform light production modes. Method (2) does achieve sufficient (+/−15%) center illumination, however it also suffers from poor blending during gradation modes. To optimize the performance of method (2), the light source row must be relatively forward and near to the outer edges of the primary diffusing panel in order to maintain the proper incident angle of light with respect to the yoke. This positioning however interferes with the primary diffusing panel in that it tends to cause a shadowing of the diffusing panel by hindering light that comes from the reflecting panel and passes through the secondary diffuser from striking and smoothly blending with the outer edges of the primary diffusing panel.

As alluded to above, the apparatus of the invention may be employed in two basic modes of operation. When the light intensities of the two light source rows are equal or nearly equal (uniform mode) the primary diffusing panel will appear, when viewed from in front of the apparatus, to be an evenly and uniformly luminous light source. In preferred embodiments a uniformity of light intensity at the primary diffusing panel of +/−10% or better can be regularly achieved with respect to any particular square inch of the primary diffusing panel. When one of the light source rows is at an intensity of light greater than the other light source row (gradation modes) it will produce a gradual variation of intensity across the primary diffusing panel, with the long edge of the diffusing panel closest to the most intense light source row being brightest. Controlling the ratio of light from one light source row with respect to the other row by independently controlling each row will control the amount of gradation across the surface of the primary diffusing panel. In practice it has been found that gradation ratios as great as 64:1 can be achieved across the width of the primary diffusing panel.

In a preferred embodiment each light source row is also provided in a conventional manner with a conventional color filtering medium and, where two different color filtering media are employed for the two light source rows, color cross fading with the banklight apparatus will also be possible, as will be readily appreciated by those skilled in the art. One anticipated application of color filtering media, with the banklight apparatus of the invention in its uniform illumination mode of operation. is use of the banklight as what is known in the film industry as a croma key blue screen.

In general, while it is possible to obtain useful performance in the apparatus without the use of reflectors associated with individual light source rows, superior performance is achieved by the use of reflectors fashioned to direct the light from a light source row in such a way as to take advantage of the overall geometry of the combination, on one side of the apparatus, of the reflecting panel, yoke, and secondary diffuser system. Preferred reflector considerations are further disclosed herein.

The edges of the panel materials which engage the frame are preferably scalloped with parabolically cut scallops and then either taped or grommeted at the vertices, or intersection points, of the various parabolic curves of the scallop cuts for quick and easy attachment of the panel material to the frame. The use of these parabolic scallops allows quick and easy stretching of the fabric across the frame in a virtually wrinkle free alignment. This attachment method also makes the panels easily removable so that the panel material may be folded or rolled and stored for transportation. The parabolic scallop cuts at the edges of the panels also allow for convection cooling of the light sources by permitting a flow of cooling air from outside the banklight to pass in and out through the scallop cuts and across the light source areas.

Any frame may be employed in the invention which allows a material to be stretched across it into a substantially planar configuration. Many such frame designs will occur to those skilled in the art. The inventor has found it useful to employ a rectangularly shaped frame as described above which is comprised of individual triangularly cross sectioned truss sections. The positioning of the various truss members within the truss section are accomplished according to methods and calculations well known in the art. A triangularly cross sectioned truss is preferred over a rectangularly cross sectioned truss because less light is reflected back to the subject (that is, light which is subject to spill from the parabolic openings at the edges of the panels), and also because of its better strength to weight ratio.

In preferred embodiments, the truss frame is in turn attached to a suspension cross piece which is itself capable of being suspended, by a suitable line or cable, from a single point. The suspension cross piece is mounted to the frame in such a way and in such a position that it occupies a latitudinal centerline of gravity across the two longer sides of the rectangular frame so that the frame hangs relatively horizontally with respect to the position of its two shorter ends. The preferred suspension system for the banklight apparatus employs a moveable carriage on a suspension cross beam, the carriage preferably having a roller at the suspension system hangpoint over which the suspension cable passes on its way to a takeup winch mounted upon the cross piece. Preferably, a second cable is attached to a sliding carriage and runs to a second takeup winch.

The suspension system provides a winch which controls a cable attached to the movable carriage to adjustably change the position of the carriage along the suspension cross piece and thus shift the hang point in relation to the banklight center of inertia so that the whole bank light assembly is able to rotate through a range of positions from parallel to the ground through positions nearly perpendicular to the ground, but without substantially changing the actual height of the center of inertia of the banklight itself. The suspension system provides for the raising and lowering of the center of inertia of the banklight by means of the other winch whose cable passes over the roller on the carriage. In banklight embodiments of width great enough to require the use of a longitudinal central truss member, the suspension cross piece may be a system of trusses itself, and in any case the exact structural nature of the suspension cross piece may be varied without departing from the scope of the invention.

Other features of this apparatus are its inherently self-baffled design which allows sufficient cooling of the light sources by convection only, while also directing resultant light spill in a direction generally opposite that of the primary diffuser, so as to avoid any unwanted light spill on the photo subject. Reflector assemblies are associated with the rows of light sources which are connected to an electrical bus bar which is common to the reflector/truss sections and which is interconnected upon assembly of the banklight.

BRIEF DESCRIPTION OF THE DRAWINGS

FIG. 8 is a schematic cross sectional detail of the lamp and reflector structure within the central truss member of FIG. 6.

FIG. 9 is a schematic cross sectional detail of an alternate embodiment of the apparatus of FIG. 1 depicting placement of the light source row and reflector in an alternate location in the apparatus.

FIG. 11 is a schematic end section of a conventional banklight apparatus.

BEST MODE FOR CARRYING OUT THE INVENTION

Figure 1:
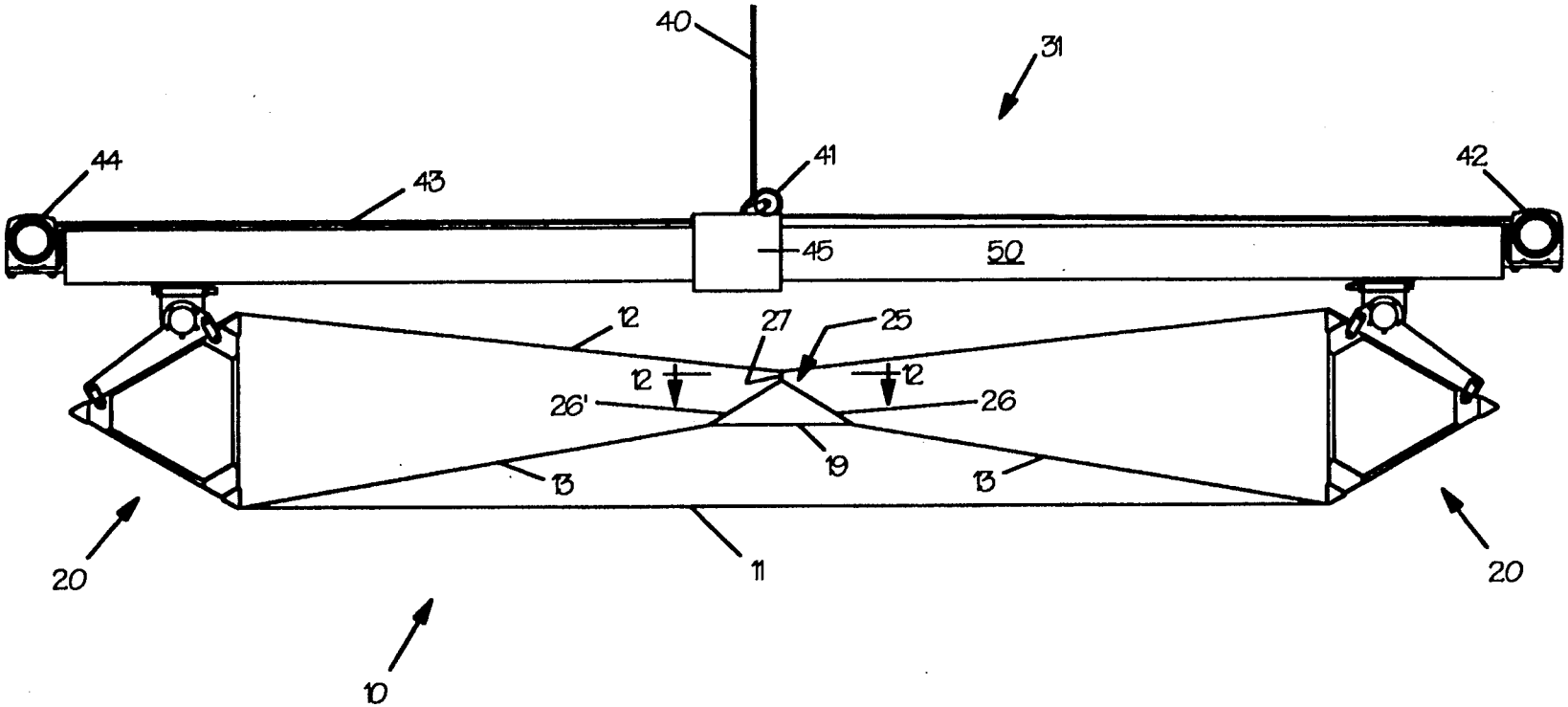
FIG. 1 is a schematic cross section of a preferred embodiment of the invention.

Referring ;now to the drawings wherein like numbers indicate like parts, a best mode of carrying out the invention is illustrated by reference to specific embodiments depicted in the drawings.

The invention may best be understood by reference first to what has gone before. FIG. 11 depicts a typical arrangement for a known banklight apparatus 1 having a curved reflecting surface 2 and light source 3, bottom reflector 4 and diffuser 5. In this known banklight apparatus, light source 3 emits rays of light, selectively shown as arrows in FIG. 11 which are prevented from downward spillage by bottom reflector 4 and generally upwardly directed to reflect off of reflector 2. Depending upon the curvature of reflector 2, that is circular, ellipsoidal, or parabolic, the nature of the direction and focusing of reflected light rays will vary. Typically, the required thickness of such an apparatus with respect to its width is in a ratio greater than 1:2 in order to effectively disperse the light across diffuser 5. Where an attempt is made to lower the height to width ratio by moving the light source line closer to the surface than the focal line would be, even greater nonuniform distribution of light reflection occurs. Known banklight apparati attempt to correct this nonuniform reflection from reflector 2 with a diffusing material 5 which to some extent causes a mixing or blending or various incident light rays.

Figure 10:
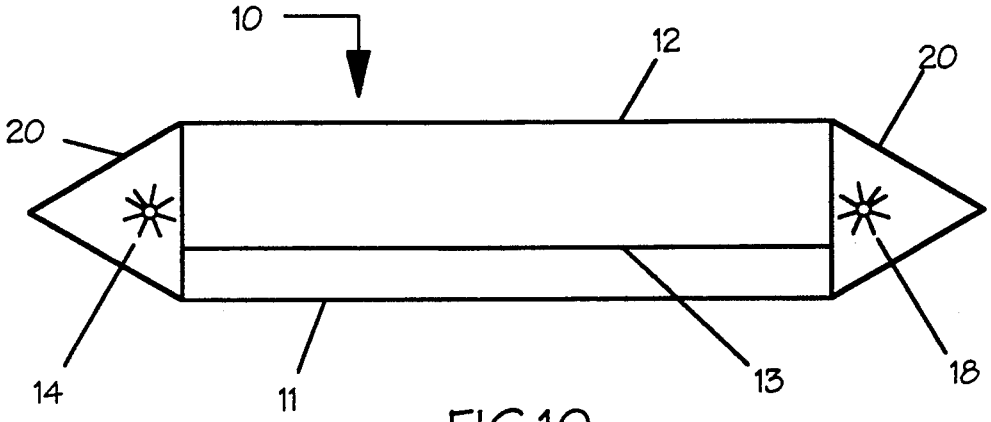
FIG. 10 is a schematic illustration of the basic apparatus of the invention.

The basic apparatus of the invention as shown in FIG. 10. Bank light 10 having an open generally rectangular framework 20 has stretched across the rear of the frame a reflecting panel 12, at either side of which are disposed first and second light source rows 14 and 18 respectively. Across the front of the framework is stretched a primary diffusing panel 11. In between reflecting panel 12 and primary diffusing panel 11 is secondary diffuser 13. Light from light source rows 14 and 18 as reflected from reflecting panel 12 onto secondary diffuser 13. Some light which strikes secondary diffuser 13 is reflected back to reflecting panel 12, and this re-reflected light adds to the homogeneity, or uniformity, of light distribution along secondary diffuser 13. Light which passes through secondary diffuser 13 is then available to illuminate primary diffusing panel 11.

Reflecting panel 12 is preferably a stretchable cloth material so that it can be stretched across the back of frame 20 to produce a smooth, or nearly smooth, reflecting surface. However other reflective materials may be substituted without departing from the scope of the invention. A type of rip stop nylon coated with aluminized polyurethane called "CC Transfer" and available from Hirsch Industries has been found to work well as reflecting panel material. Aluminized mylar has better reflectivity but does not appear to hold up to repeated stretching. In order to promote more uniform distribution and diffusion of reflective light the reflecting panel material is preferably embossed all over with a uniformly distributed pattern of raised dots. Aluminized KEVLAR TM with vacuum deposited aluminum could also be used, but it is believed that this material would be hard to emboss. Secondary diffuser 13 may be made from three quarter ounce spinnaker cloth available from Challenge Sail, and is preferably made of calendarized NYLON, DACRON, or a blend, to help prevent direct light spots from showing through the diffuser. The primary diffuser is preferably a two ounce white dacron preferably with both a high thread count and calendarized as well. A 400 thread count is preferred, and the tighter the thread count the better. This particular two ounce white dacron is imported by Wide Fabrics in Los Angeles, Calif.

Light source rows 14 and 18 are preferably rows of spaced tungsten lamps of the quartz halogen variety, xenon flashtubes, or HMI lamps (or any short arc, or other arc, discharge lamps made for the film industry or other purposes and well known to those skilled in the art), but may also even be a series of fluorescent tubes or other lamps known in the industry. It has been found that Sylvania or General Electric quartz halogen lamps with tungsten filaments on centers spaced between twelve and twenty four inches apart along the respective light rows have provided good results. Lamps meeting ANSI code FCM are preferred, but General Electric model Q250MC 250 watt lamps and Sylvania model 500Q 500 watt lamps also work well. A particular light row is best provided with uniform lamping and spacing, depending however on the job application and the banklight size. An additional advantage may be had by employing xenon photo flashtubes instead of quartz halogen lamps.

Figure 4:
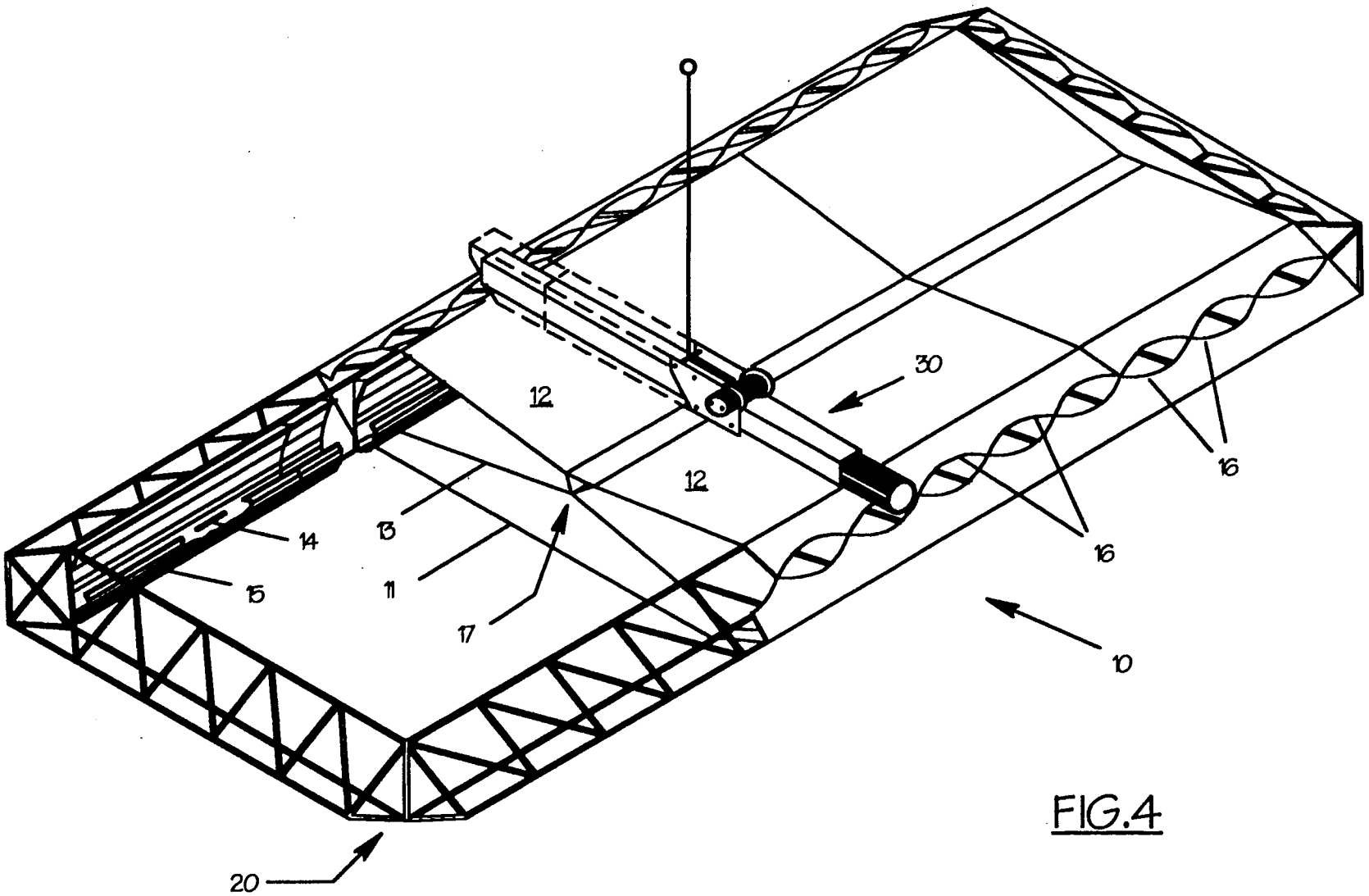
FIG. 4 is an isometric view of an assembled apparatus of the invention in an alternate embodiment with some of the stretched panel material cut away to reveal interior detail.
Figure 5:
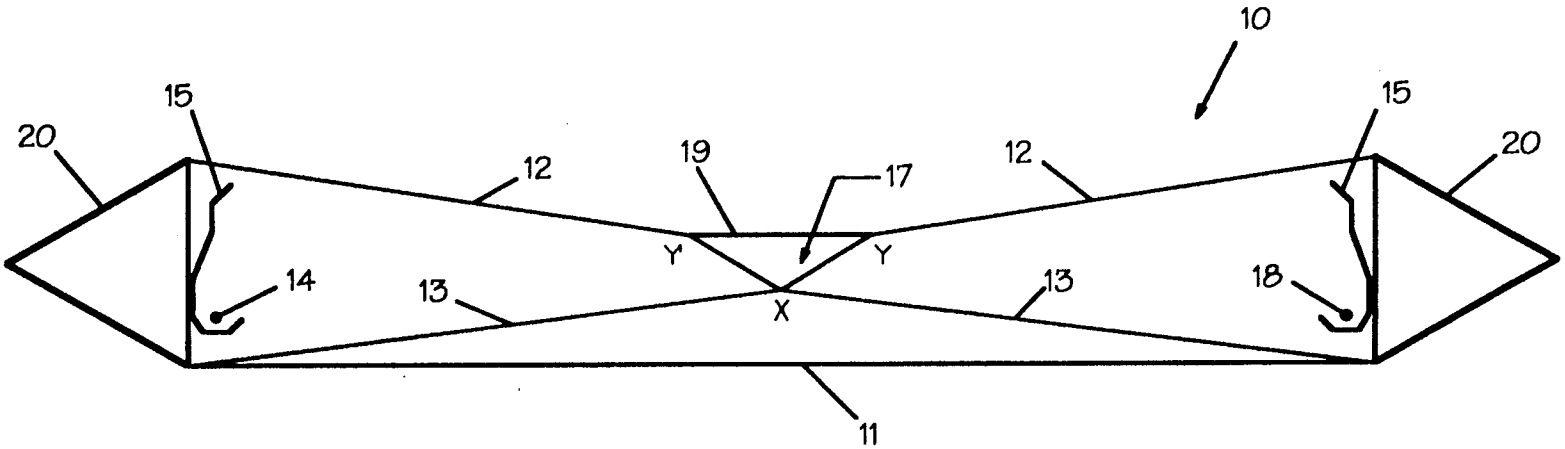
FIG. 5 is a schematic cross sectional view of the apparatus of the FIG. 4.

In an earlier, prototypical embodiment, illustrated in FIGS. 4 and 5, an improvement to the basic design of the invention was tested. A more or less rectangularly arranged triangularly cross sectioned truss frame 20, suspended from a suspension system 30 acts as the framework for the reflecting and diffusing panels of the invention and as mounting platform for the light rows. Disposed along both of the long sides of frame 20 are reflecting troths 15 within which are disposed first light source row 14 and second light source row 18. Light sources 14 and 18 and reflectors 15 are designed to illuminate and direct light primarily to the reflecting panel 12, and in addition to that part of reflecting panel 12 lying between points y' and x, and y and x in FIG. 5.

Light impinging upon reflecting panel 12 is reflected downwardly to secondary diffuser 13 where some of the light incident to the upper surface of secondary diffuser 13 is reflected back to reflecting panel 12, and then re-reflected back down to secondary diffuser 13, and the rest of the light incident to secondary diffuser 13 is passed through to impinge upon the upper surface of primary diffusing panel 11. Secondary diffuser materials are preferably selected so that something approximating half of the light incident to the surface of secondary diffuser 13 is typically reflected backwardly.

This bouncing of light between reflecting panel 12 and secondary diffuser 13 creates in and of itself a virtually first order approximation of uniformly distributed light, assuming that the intensity of the illumination from first light source 14 and second light source 18 are substantially equal. Light then strikes primary diffusing panel 11 in something already approximating uniform diffusion, and thus light emitted forwardly from primary diffusing panel 11 is assured of being nearly uniform. Light measurements across the width of primary diffusing panel 11, even in this earlier embodiment, indicate that the light intensity, where both light sources are at equal intensities, are uniform to within +/−15%, and in preferred embodiments to within +/−10%, as illustrated by the solid line at the top of the graph in FIG. 3.

The embodiment in FIGS. 4 and 5 differs principly from that illustrated schematicly in FIG. 10 in the presence of yoke 17. Secondary diffuser 13 and reflecting panel 12 are attached to one another in the region of their longitudinal centers by yoke 17. Yoke 17 is positioned and dimensioned in such a way that reflecting panel 12 is angled from the frame edges toward the center at a catenary angle below the horizontal. In like manner, secondary diffuser 13 is angled upwardly from the horizontal. Yoke 17 is connected to secondary diffusing panel 13, typically by a sliding closure at point x in FIG. 5 and is comprised of the central portions of reflecting panel 12 together with a yoking panel 19 to comprise yoke 17. Yoking panel 19 is joined along two parallel lines to reflecting panel 12, preferably with sliding closures such as zippers, but may also be sewn or fastened in some other manner. Yoking panel 19 pulls reflecting panel 12 into the yoke configuration 17 schematically illustrated in FIG. 5 between points yxy'. It should be noted for later comparison with other embodiments that the portions of yoke 17 between x and y' and between x and y are, in this embodiment, actually portions of reflecting panel 12.

Figure 3:
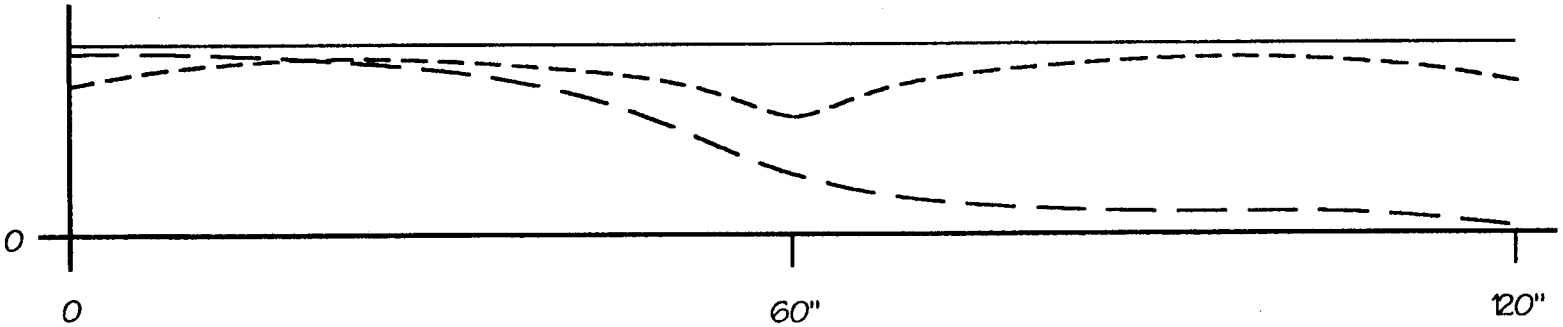
FIG. 3 is a combined graph of light intensities measured across the width of two alternate embodiments of the apparatus of the invention.

The basic triangularly cross sectioned structure of yoke 17 was selected initially in favor of merely joining reflecting panel 12 and secondary diffuser 13 along a single longitudinally centered seam, because the centered seam method of joining the two panels produced a plot of light intensity across the width of primary diffusing panel 11 illustrated by the dotted line in the graph of FIG. 3. That is, even with equal intensity light sources at either side of the reflecting panel 12, a marked "dip" in intensity could be measured in the center portion of primary diffusing panel 11. Using yoke 17 and the design illustrated in FIGS. 4 and 5 produced the solid line intensity graph at the upper portion of the graph of the FIG. 3. This embodiment however did not prove optimal for applications where one light source was run at a lower intensity than the other light source in order to produce a gradation of light intensity across the width of the primary diffusing panel 11. When this is attempted with the embodiment illustrated in FIG. 5, the broken line of the graph of FIG. 3 is the resultant intensity curve. That is, the intensities of light measured across the center of primary diffusing panel 11 drop drastically rather than smoothly with this configuration.

Figure 7:
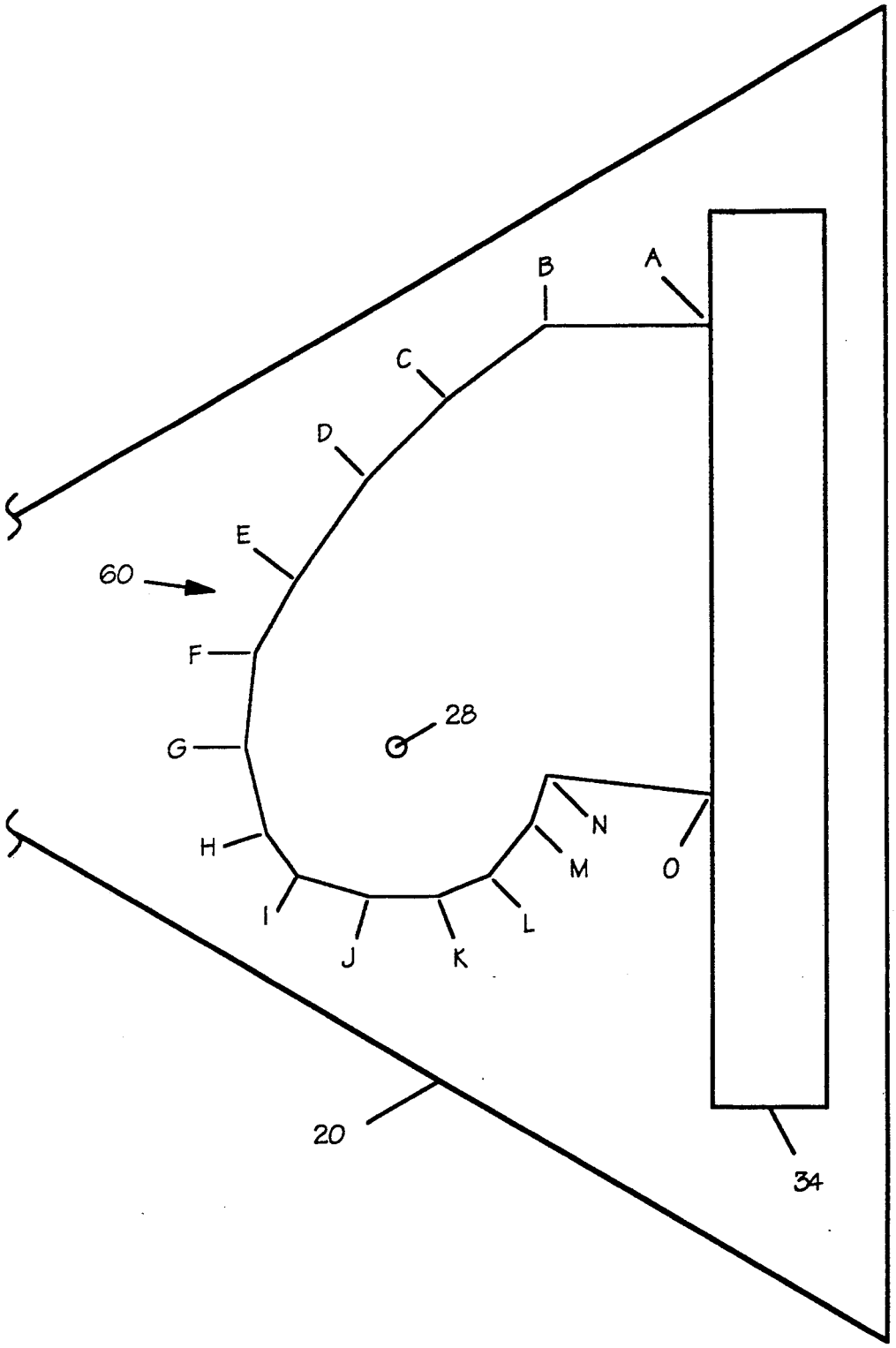
FIG. 7 is a schematic cross sectional detail of the apparatus of FIG. 1 depicting a preferred placement of light source row and reflector.

FIG. 1 illustrates a preferred embodiment of the apparatus of the invention. It should be noted that FIG. 1 is schematic in nature and also does not illustrate the preferred positioning of light source rows or reflectors which are illustrated in FIGS. 7 and 9. In FIG. 1, primary diffusing panel 11 is essentially the same as depicted in FIGS. 4 and 5. However, owing to an improved design of yoke 25 over that of yoke 17, the shape and geometry of reflecting panel 12 and secondary diffuser 13 differ substantially from that disclosed in the embodiment shown in FIGS. 4 and 5. Also illustrated in FIG. 1 is a preferred embodiment of the suspension system 31 of the invention.

Yoke 25 is comprised of yoke panels 26 and 26' and a portion of secondary diffuser 13 lying between the outer edges of panels 26 and 26'. Yoke 25 also has yoke connector 27 to attach the apex of yoke 25 to the longitudinal centerline of reflecting panel 12. Yoke connector 27 is preferably a slide closure, such as a Number 10 nylon molded zipper, for ease of attachment and disconnection of yoke 25 from reflecting panel 12. However other methods of attachment of yoke 25 to reflecting panel 12, including permanent stitching, may also be used. In this embodiment, yoke panel 19 is not necessarily a separate piece of material, but is simply that portion or secondary diffuser 13 which lies between the outer edges of yoke panels 26 and 26'.

Figure 12:
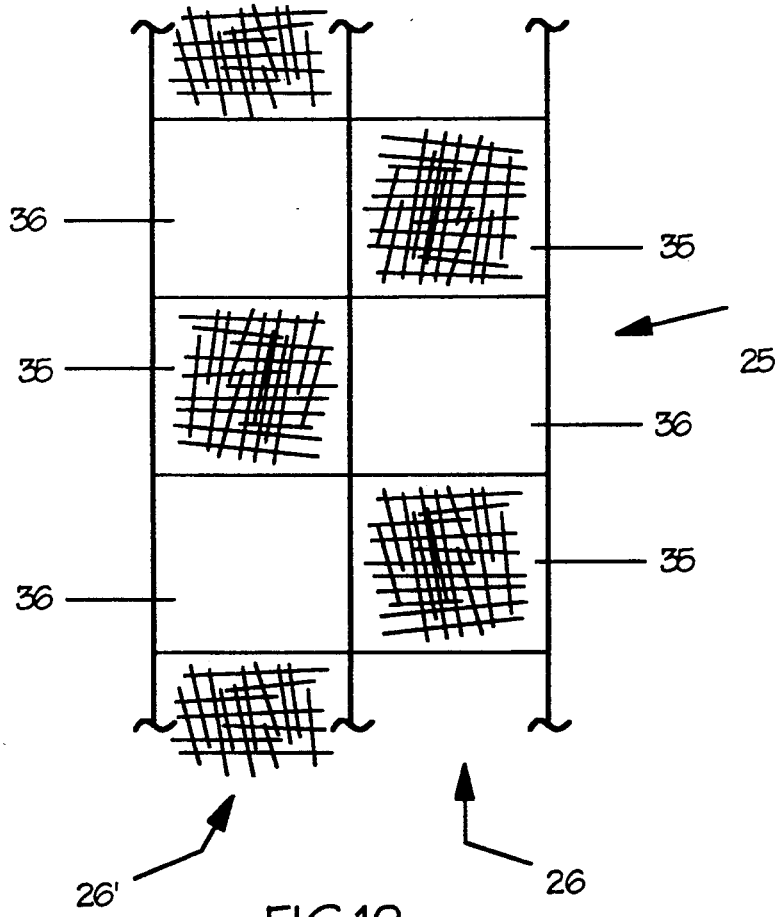
FIG. 12 is a partial plan view of Yoke 25 taken along line 12—12 of FIG. 1.

In preferred embodiments, yoke panels 26 and 26', more clearly illustrated in FIG. 12, are actually comprised of subsections of material, alternating between a mesh cloth and a diffusing material similar to that used for secondary diffuser 13. This alternation of mesh with nonmesh cloth, together with the opposition of a mesh section for instance on panel 26, with a nonmesh section on panel 26', allows cross convectional airflow while at the same time substantially baffling light from crossing over from one side of the banklight to the other. Preferred yoke panels 26 and 26' will employ mesh sections approximately half the length of the nonmesh sections, with one foot long mesh sections preferred. A preferred mesh cloth is available from Fablok Mills, fabric number 9622. This is a dacron knitted mesh which is preferably calendarized in order to bond the thread intersection to prevent distortion of the mesh under tension.

Figure 2:
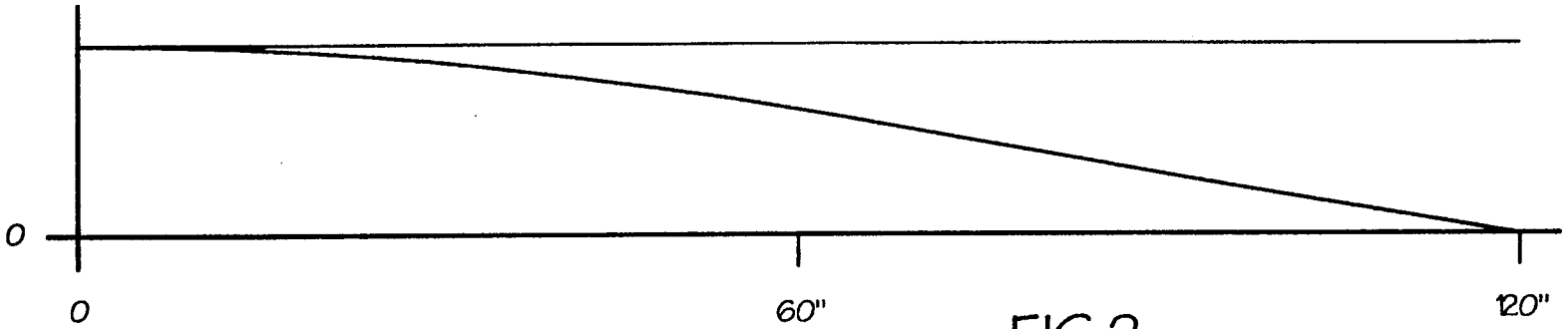
FIG. 2 is a graph of light intensity measured across the width of a preferred embodiment of the apparatus of the invention for two different ratios of light intensity between the two light source rows of the apparatus.

The design of yoke 25, which is inverted with respect to yoke 17 of FIGS. 4 and 5, is used in conjunction (as illustrated in FIGS. 7 and 9) with a more rearward placement of the reflector associated with the light source row 28. This rearward and outer placement of the light source rows and the design of yoke 25 yields improved performance over the earlier design, principly in modes of operation where different intensities of light are used for the respective light source rows. In this gradation mode, yoke panel 19 is used to blend the different intensities across secondary diffuser 13 to achieve a more constant change in surface intensity along diffusing panel 11. Graphs of intensity measurements using the embodiment shown in FIG. 1 are illustrated in the graph of FIG. 2. The solid straight line represents measurements of intensities across diffusing panel 11 when the intensities of the two light sources are equal, and the sloped line represents graph of intensities across the width of diffusing panel 11 when one light source is at zero intensity and the other light source is at full intensity. It will be appreciated that the slope of the line in this latter case is nearly flat as compared to the broken line in the graph in FIG. 3 for the earlier embodiment.

Of the two reflector arrangements shown in FIGS. 7 and 9, the one illustrated in FIG. 7 is preferred in that the more precisely controlled shape of reflector 60 in FIG. 7 allows greater control of the light directed ultimately toward the center of primary diffusing panel 11. However the reflector 22 of FIG. 9 also yields satisfactory performance. Reflector 22 is typically ellipsoidal and employs flap 23 to reflect light back down to the outer edges of primary diffuser 11, and bottom reflector 4 to prevent direct light spill to the secondary diffuser 13. For cooling, air gap 21 is provided.

Preferred dimensions for reflector 60 may be had by reference to Table I below. The letters in the table correspond to the lettered intersection points of the planes of reflector 60 in FIG. 7 and the numbers in the table correspond to grid references on a standard x-y coordinate system where the zero datum point reference is the centerline of light source row 28. Thus in Table I the numbers for point A are −16x and 19y. This means that on any standard graph paper, with an arbitrary point selected for the centerline of light source row 28, the corresponding datum points for reflector 60 may be plotted. A reflector template may then be laid out from the graph paper plot of the data from Table I. Actual dimensions may then be scaled from the graph paper. For example in a preferred embodiment, with graph paper spacings of ¼ inch, every four spaces will equal one inch and the template derived will be full scale for a banklight with 22 inch side triangular truss sections. The template will represent the inside dimensions of the reflector. A reflector may then be formed by using standard sheetmetal brake techniques. A preferred material for reflector 60 is COILZAK TM type one specular lighting sheeting (83% specular or better preferred).

TABLE I

| | x coord | y coord |
|---|---|---|
| A | −16 | 19 |
| B | −8 | 19 |
| C | −3 | 15.5 |
| D | 1 | 11.5 |
| E | 4 | 7.5 |
| F | 5.5 | 4 |
| G | 6 | 0 |
| H | 5 | −4 |
| I | 3.5 | −6 |
| J | 0 | −7 |
| K | −3 | −7 |
| L | −5.5 | −6 |
| M | −7 | −4 |
| N | −8 | −1.5 |
| O | −16 | −2.5 |

In the reflector positioning shown in FIG. 7 media frame 34 is also illustrated. Media frame 34 may be an adaption of the common gel frame or a frame to hold various color filters well known in the art. Where light sources in the apparatus of the invention are thus filtered or otherwise colored, and particularly where each light source has a different color, cross fading the two light sources will not only produce a gradation of light intensity across primary diffusing panel 11, it will also produce a gradation in color. In this way, for instance, an effect such as a dark blue to lighter gold gradation similar to the effect found in nature after a sunset with a cloudless day may be achieved to photographic advantage. Also where block control of the lamps along any particular light source row is effected, as will be readily understood by those skilled in the art, it will also be possible by controlling intensities along the row to create end to end gradations in light intensity as well as spot enhancement.

As an illustration of a proven high performance banklight configuration, the following dimensions are provided. For a generally rectangularly truss frame with triangular cross sectioned truss sections 22 inches on a side, the primary diffusing panel 11 is 121 inches wide, the secondary diffuser is 122.5 inches wide (including the 16 inch portion of secondary diffuser 13 which has been referred to herein as yoke panel 19), and reflecting panel 12 is 121.7 inches wide. Yoke panels 26 and 26' have a width of 9.44 inches each. And the distance between yoke panel edges at their jointure with secondary diffuser 13 to the outer edge of secondary diffuser 13 is 53.25 inches on each side of yoke 25. Of course other dimensions may be employed without departing from the scope of the invention, and the above dimensions are illustrative only.

Figure 6:
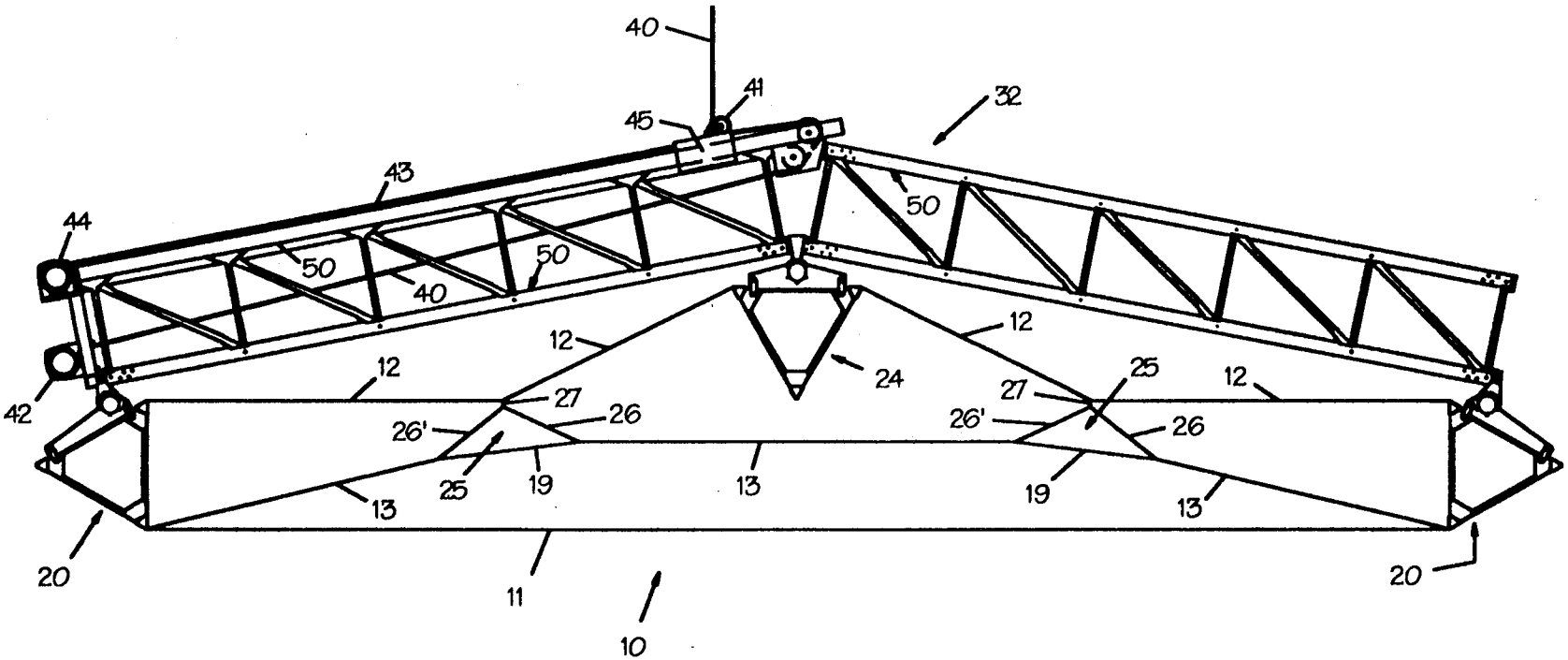
FIG. 6 is a schematic cross section of an alternate embodiment of the invention shown in FIG. 1 employing a central truss member and third light source row, and depicting an alternate embodiment of the suspension cross piece of FIG. 1.

Another embodiment of the apparatus of the invention is schematically depicted in cross section in FIG. 6. This embodiment is particularly well suited to very wide banklights in the range of 20 feet in width. The apparatus in FIG. 6 may be conceived of as two of the panel assemblies illustrated in FIG. 1 joined side to side in a central region of the apparatus illustrated in FIG. 6. In order to effect such a "joining" of the panel assemblies, while assuring structural integrity, and in order to preserve the virtual uniform distribution of reflected and diffused light, a longitudinal truss frame member 24 is employed in the central and midline portion of the banklight apparatus 10. In fact, single primary diffusing panel 11 is stretched between frame members 20, and a single secondary diffuser 13 is stretched between frame members 20. However two reflecting panel pieces 12 and two yokes 25 are employed, where each reflecting panel 12 is stretched between one frame member 20 and central frame member 24. Geometric and illumination considerations differ from the embodiment disclosed in FIG. 1 however, notably in the necessity of having an inner portion of each of reflecting panels 12 at a steeper angle with respect to primary diffusing panel 11. Also a light source row is preferably placed inside the structure of truss member 24 in order to provide full illumination for the central portion of this wider embodiment. That illuminating structure is further discussed below in the paragraph making reference to FIG. 8.

A suitable geometry may be established in this wide embodiment by employing a primary diffusing panel which is 219 inches wide, a secondary diffuser which is 222 inches wide, two reflecting panels which are each 103.3 inches wide, and two yokes 25 having panels 26 and 26' each 14.15 inches wide and attached to secondary diffuser 13 so as to create apparent yoke panel 19 widths of 24 inches between legs 26 and 26', with 73 inches across the central portion between yokes 25, and 50.5 inches on either outer side of diffuser 13 between frame 20 and yokes 25. Yoke link 27 for each of the yokes is attached to divide the respective reflecting panels 12 into apparent panel widths, proceeding from left to right across the drawing toward the central truss member and thence symmetrically to the other frame member of 60 inches and 43.3 inches respectively. Frame 20 is also 22 inches on a side.

The placement of light central light source 28 and a gull wing reflector 29 is illustrated in FIG. 8 for the apparatus shown in FIG. 6. The bottom reflector 33 also functions to prevent bottom spill of light from light source 28 directly downward to secondary diffuser 13 and primary diffusing panel 11. Gull wing reflector 29 and bottom reflector 33 both serve to aim and direct the light from light source 28 generally to the sides of truss member 24 for reflection from reflecting panel 12 and also, where reflected from reflectors 29, downwardly to secondary diffuser 13 and outwardly primarily to the area of panel 26. Gull wing reflector 29 sections C-D and D-E are preferably embossed in the "hammertown" style. As with the data for reflector 60 is FIG. 7, the data from Table II below will serve to particularly describe a preferred embodiment of gull wing reflector 29 and bottom reflector 33 in FIG. 8.

TABLE II

| | x coord | y coord |
|---|---|---|
| A | 0 | 13.5 |
| B | −4 | 16 |
| C | −9 | 18 |
| D | −14 | 17 |
| E | −18 | 15 |
| H | 0 | −5 |
| I | −2 | −6 |
| J | −7 | −4 |

In both FIGS. 1 and 6 where suspension systems 31 and 32 respectively are illustrated, and although the beam structure of the suspension systems can vary significantly, the functioning of the invention of the suspension system is nonetheless the same. Suspension cable 40 (which comes down from some hanging device such as a crane or boom, not shown) passes around hangpoint roller 41 and is attached to winch 42. To the extent that the position of carriage 45 does not change along beam 50, the action of winch 42 will serve generally to raise or lower banklight 10 without changing its angled orientation. However, cable 43 attached at one end to carriage 45 and at the other to winch 44, together with the winching action of winch 44, provides a means of moving carriage 45 as follows: pulling cable 43 into winch 44 slides carriage 45 leftwardly in the illustration, effectively offsetting the pick point in the horizontal axis from the system center of inertia; as carriage 45 moves leftward, the system naturally changes the angle it hangs relative to the ground; secondarily as carriage 45 moves leftward, roller 41 is moved upwardly along cable 40 causing the entire system to move upwards, thus offsetting the downward movement of the system center of inertia caused by the leftward displacement of the pick point. All of the parts and specifications for the beam, carriage, rollers, cables, and winches will already be well known to those skilled in the art.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

I claim:

1. A banklight comprising:

a) a frame b) a primary diffusing panel disposed across a front portion of said frame;

c) a reflecting panel disposed across a rear portion of said frame;

d) a secondary diffuser disposed across said frame between said primary diffusing panel and said reflecting panel;

e) a light source row disposed along at least one side of said reflecting panel between said reflecting panel and said secondary diffuser;

wherein said frame is substantially rectangular and is substantially open along said front and said rear portions, and wherein said frame is further comprised of a plurality of truss members.

2. The apparatus of claim 1 wherein each of said truss members is an equilateral triangularly cross sectioned truss with one of the faces of said truss disposed inwardly.

3. A banklight comprising:

a) a frame b) a primary diffusing panel disposed across a front portion of said frame;

c) a reflecting panel disposed across a rear portion of said frame;

d) a secondary diffuser disposed across said frame between said primary diffusing panel and said reflecting panel;

e) a pair of light source rows each disposed along one of two opposite longer sides of said reflecting panel and located between said reflecting panel and said secondary diffuser;

wherein said reflecting panel and said secondary diffuser each have longitudinal midportions and are connected along their respective longitudinal midportions.

4. The apparatus of claim 3 further comprising a yoke for connecting said reflecting panel and said secondary diffuser, said yoke comprised of two dihedral yoke panels joined along a vertex, and wherein said vertex is connected to said reflecting panel along a longitudinal centerline of said reflecting panel.

5. The apparatus of claim 4 wherein outer edges of said yoke panels are connected to said secondary diffuser along lines parallel to each other and to the longitudinal centerline of said secondary diffuser.

6. The apparatus of claim 4 wherein each of said yoking panels is comprised of alternating sections of mesh material and nonmesh material.

7. The apparatus of claim 6 wherein said alternating sections of each respective yoking panel are in opposition to one another so that a mesh section on one panel opposes a nonmesh section on the other panel.

8. A banklight comprising:

a) a frame b) a primary diffusing panel disposed across a front portion of said frame;

c) a reflecting panel disposed across a rear portion of said frame;

d) a secondary diffuser disposed across said frame between said primary diffusing panel and said reflecting panel;

e) a light source row disposed along at least one side of said reflecting panel between said reflecting panel and said secondary diffuser;

wherein said frame is substantially rectangular in overall configuration and comprised of a plurality of equilateral triangularly cross sectioned truss members with at least one truss member disposed longitudinally across a rear center portion of said frame.

9. The apparatus of claim 8 further comprising at least two reflecting panels each disposed across a rear portion of said frame between an outside truss member of said frame and said central truss member.

10. The apparatus of claim 9 further comprising a pair of light source rows each disposed along one of two opposite longer sides of each said reflecting panel.

11. The apparatus of claim 10 wherein each reflecting panel is connected to said secondary diffuser along a midportion of each reflecting panel by a yoke which connects to said secondary diffuser panel in such a way as to create a central region of said secondary diffuser which is parallel to said primary diffusing panel.

12. A method of uniform diffuse lighting comprised of the following steps:

a) illuminating a reflecting panel from at least one light source disposed forwardly and to the side of said reflecting panel;

b) interposing forwardly of said reflecting panel and said light source a secondary diffuser; and c) interposing forwardly of said secondary diffuser a primary diffuser;

wherein said secondary diffuser and said reflecting panel each have longitudinal midportions, and are connected to each other along said longitudinal midportions.

13. The method of claim 12 wherein said reflecting panel and said secondary diffuser are connected by a dihedral yoke.

* * * * *